United States Patent [19]

Green et al.

[11] Patent Number: 4,525,096

[45] Date of Patent: Jun. 25, 1985

[54] CONNECTING CLAMP FOR BUILDER'S SCAFFOLDING

[75] Inventors: Jasper L. Green, Anaheim; Steven B. Hackett, Irvine, both of Calif.

[73] Assignee: Weldtec, Inc., Fountain Valley, Calif.

[21] Appl. No.: 485,886

[22] Filed: Apr. 18, 1983

[51] Int. Cl.[3] ..... E04G 7/00

[52] U.S. Cl. ..... 403/49; 403/79; 403/395; 403/398; 182/179

[58] Field of Search ..... 403/49, 395, 398, 399, 403/79, 157; 182/178, 179

[56] References Cited

U.S. PATENT DOCUMENTS

| | | | |
|---|---|---|---|
| 505,810 | 10/1893 | Brower | 403/399 |
| 562,385 | 6/1896 | Frost | 403/398 |
| 3,179,212 | 4/1965 | Gostling | 403/49 X |
| 3,350,750 | 11/1967 | Scarr et al. | 403/157 |
| 3,420,557 | 1/1969 | Francis et al. | 182/179 |
| 3,755,860 | 9/1973 | Schenk et al. | 403/398 X |
| 4,044,523 | 8/1977 | Layher | 403/49 X |
| 4,372,424 | 2/1983 | Langer | 182/179 X |

*Primary Examiner*—Thomas F. Callaghan
*Attorney, Agent, or Firm*—Weissenberger and Peterson

[57] ABSTRACT

A connector for use in builder's scaffolding systems for connecting crossmembers to upright members where the upright members have sockets provided thereon and each of the sockets has an internal clamping face. The connector is coupled to one end of the crossmember. It has an upper and a lower limb spaced apart for receiving the socket therebetween. A generally trapezoidal opening having four sides, two of which are non-parallel, is provided in the two limbs. In engaging the connector, two of the four sides form first and second clamping sides. A wedge coupling member is received within the trapezoidal opening and mounted for clamping engagement with the internal clamping face of the socket and selected portions of the first and second clamping sides. The trapezoidal opening permits connection of the crossmember at a plurality of angles to the upright within the range permitted by the first and second clamping sides.

The connector is further provided with an abutment coupling having two spaced-apart arms for permitting at least one of the limbs to be received therebetween. The arms have an aperture through which the wedge member can pass free of clamping action. An abutment face is provided on the abutment coupling for abutting the upright member when the wedge clamping member is in pressure engagement with the first and second clamping sides and the internal clamping face of the socket.

2 Claims, 15 Drawing Figures

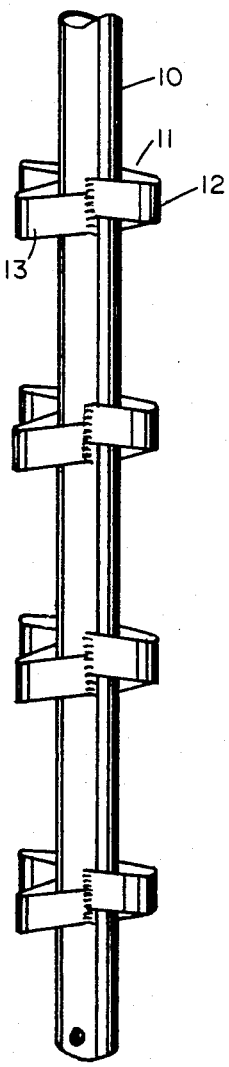
FIG. 1
PRIOR ART
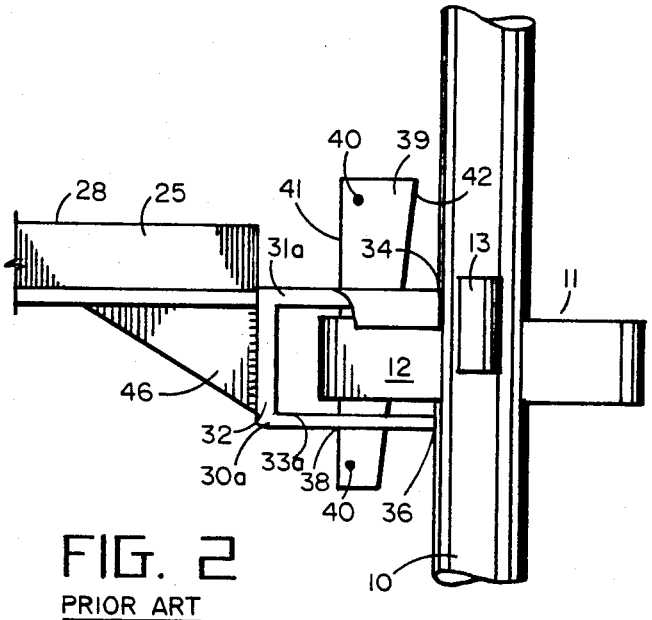
FIG. 2
PRIOR ART
FIG. 3
PRIOR ART
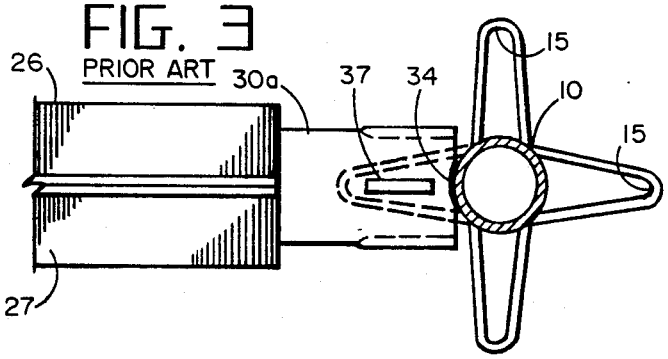

CONNECTING CLAMP FOR BUILDER'S SCAFFOLDING

This invention relates to builders' scaffolding of the type which comprises a plurality of upright members connected by crossmembers. More particularly it relates to scaffold connecting clamps by which the crossmembers are coupled to the upright members.

In builders' scaffolding systems, clusters of sockets are provided at spaced intervals on the upright members and scaffold clamps attached to the crossmembers grip these sockets to provide support for the ledger and transom elements.

U.S. Pat. No. 3,420,557 to L. W. Francis shows one type of prior art connector means comprising a C-shaped channel welded at its base to a crossmember. The C-shaped connector means has upper and lower limbs which are spaced apart to receive the socket of the upright member therebetween. The upper and lower limbs are provided with elongated rectangular slots through which a wedge clamping member passes and secures the connector means to the socket. One difficulty with this type of connector means is that the elongated slot for receiving the wedge clamping member does not permit any sideways connection of the connector means, and thereby permits the crossmember to be coupled to the socket in only one position.

U.S. Pat. No. 3,179,212 to P. E. Gostling shows another prior art connector means for gripping sockets provided on the upright member. Here again, the wedge clamping member moves within a rectangular slot which does not permit any sideways connection of the connector means and the crossmember. The crossmember attaches to the socket in only one position.

In erecting a scaffolding system, it is oftentime desirable to connect the crossmember to the socket in a manner angularly displaced, in a horizontal plane about the vertical longitudinal axis of the upright member. This is not possible with the prior art connector means described above.

It is an object of the present invention to provide a connector means for connecting crossmembers to uprights at any angle within a particular range.

It is also an object of the present invention to provide a connector means having an abutment coupling for abutting the upright member when the connector means is coupled to the socket.

It is another object of the invention to provide the upright member with donut-shaped plates or disks having a plurality of slots, and the connector means adapted to be coupled to selected one of the slots. Another object of the invention is to allow the connector means some sideways or angular movement.

SUMMARY OF THE INVENTION

The present invention is a novel connector means coupled to the crossmember which permits angular placement of the crossmember in a horizontal plane about the longitudinal axis of the upright member.

The connector means of the present invention is utilized in builders' scaffolds having an upright member provided with a plurality of spaced-apart sockets. The connector means is a C-shaped member attached at its base to the crossmember and has two spaced-apart limbs to permit the socket to be received therebetween, with the limbs extending respectively above and below the socket. A generally trapezoidal opening is provided in each of the limbs. The trapezoidal opening has four sides, at least two of which are non-parallel, and any two of which may form the first and second clamping sides of the trapezoidal opening. The first and second clamping sides provide a plurality of clamping positions of the trapezoidal opening.

A wedge clamping member is mounted to pass through the trapezoidal openings in the first and second limbs. During the coupling action for coupling the connector means to a socket, the wedge clamping member engages the internal clamping face of the socket and selected positions of the first and second clamping sides of the trapezoidal opening. The trapezoidal opening allows movement of the wedge clamping member therein for setting at a variety of clamping positions. Thus the connector means may be moved within the range permitted by the first and second clamping sides of the trapezoidal opening. Of course, with the connector means, the crossmember may be angularly displaced in a horizontal plane with respect to the vertical longitudinal axis of the upright member. The shape of the trapezoidal opening determines the extent of the angular displacement.

The trapezoidal opening may comprise parallel arcuate first and second clamping sides, the second side being smaller than the first side, and linear edge sides connecting the ends of the first and second clamping sides. Optionally, the trapezoidal opening may be arranged to have the two linear sides situated substantially at right angles. Also, one side may be arcuate and the opposite side may be made so small that the trapezoidal opening comprises substantially a quadrant of a circle. The first and second clamping sides may comprise adjacent or opposite sides of the trapezoidal opening.

The connector means is further provided with an abutment coupling having first and second spaced apart arms to permit one of the limbs of the connector means to be received therebetween and a joining portion joining said arms at one end. The outer surface of the joining portion forms an abutment face configured to abut and bear against the outer surface of the upright member. For example, where the upright member is a circular tube or pipe, the abutment face is complementarily arcuate. Preferably, the first and second arms are parallel and the abutment face depends at right angles from one arm.

The arms of the abutment coupling are provided with an aperture through which the wedge clamping member can pass free of clamping action. The aperture does not permit any sideways movement of the wedge clamping member therein.

The abutment coupling can be moved to different angular positions as the wedge clamping member is moved to different clamping positions within the trapezoidal opening. This can be arranged by forming the limbs such that there is no interference between the movement of the abutment coupling and the limbs. The abutment face is arranged to abut the upright member at all times irrespective of the change of position of the cross-member.

In addition to providing an abutment face, the abutment coupling may serve to retain the wedge clamping member in association with the connector means. For this purpose, the wedge clamping member is provided with protrusions at its ends and these protrusions cannot pass through the aperture in the arms. Thus the wedge clamping member remains captured in association with the connector means. In addition, since the two arms of the abutment coupling receive one limb, and the wedge clamping member passes through the trapezoidal opening in the limb, the abutment coupling also remains captured in association with the connector means.

If desired, both of the limbs of the connector member may be provided with the abutment coupling. For example, the second abutment coupling for the lower limb may have apertures to allow the protrusions on the wedge clamping member to pass therethrough and may be removable from association with the connector means. At the time of coupling the connector means the second abutment coupling may be attached to the lower limb.

Another manner of providing the abutment coupling is with only one arm, for example, the abutment coupling described above but without the upper arm. Additionally, it may be formed as a planar plate with one portion contoured to act as an abutment face.

In using the connector means of the present invention when the scaffolding is being erected, the crossmember is loosely coupled to a socket of the upright member with the wedge member positioned to pass through the trapezoidal opening in the upper limb, through the socket, and through the trapezoidal opening in the lower limb of the connector means. In this position, the crossmember is supported by the socket and it is unnecessary for a workman to support the crossmember. The crossmember may be moved and angularly displaced in a plane horizontal about the longitudinal axis of the upright member within the range permitted by the trapezoidal opening. Once a desired position of the crossmember has been selected, the wedge clamping member is forced down with a hammer blow into clamping engagement with the internal clamping face of the socket and portion of the first and second clamping sides of the trapezoidal opening that the wedge member is in contact with.

When the above connector means is provided with an abutment coupling, the wedge clamping member passes through the aperture in the first arm, the trapezoidal opening in the upper limb, the aperture in the second arm, the socket and the trapezoidal opening of the lower limb. When the wedge clamping member is hammered down, the wedging action thereof forces the abutment face to bear against the upright member.

The connector means of the present invention may be utilized with upright members provided with donut-shaped plates or disks in lieu of the sockets. The donut-shaped plates are an inventive feature of the present invention. The donut-shaped plates have a plurality of slots situated in a selected manner. For example, the slots may be spaced apart from each other by a particular angle. If only four slots are provided, they may be spaced apart by ninety degrees, if ten slots are provided, they may be spaced apart by thirty-six degrees. Each of the slots has first and second clamping sides and receive the wedge clamping member. Preferably, the wedge clamping member is rectangular in cross section and the slots are also rectangular.

The donut plate slots permit attachment of the crossmember at a great number of positions. The conventional connector means may be used with the donut-shaped plate.

If each of the slots in the donut plates are spaced apart by thirty-six degrees, and it is desired to connect a crossmember in-between two adjacent openings, i.e. spaced about eighteen degrees from one slot, the conventional connector means cannot be used. However, the connector means of the present invention may be utilized. The connector means is coupled loosely to one of the slots in the donut plate, i.e. with the wedge clamping member loosely positioned to pass through the trapezoidal openings in the upper limb of the connector means, the slot in the donut plate and the opening in the lower limb of the connector means. The crossmember is then moved to the desired position and the wedge clamping member is forced into engagement with the portions of the first and second clamping sides of the trapezoidal openings in the upper and lower limb and the clamping sides of the slot in the donut plate.

In using the connector means with the above donut plates, the abutment face of the abutment coupling is brought into engagement with and bears against the upright member.

The donut plate may be provided with a generally trapezoidal slot, in addition to or apart from the rectangular slots. The trapezoidal slot has four edges, at least two of which are non-parallel. Preferably the trapezoidal slot has arcuate and parallel first and second clamping edges, the second edge being smaller than the first. The first and second clamping edges provide a range of clamping positions for the wedge clamping member. The prior art connector means may be used and can be attached at any angle to the trapezoidal slot within the range permitted by the first and the second clamping edges. This increases the versatility of the prior art connector means.

The trapezoidal slot may be formed like the trapezoidal opening in the limbs of the connector means. For example, the generally trapezoidal slot may be arranged to have its two edges linear and situated substantially at right angles. Also, one of the four edges may be arcuate and the edge opposite thereto be made so small that the trapezoidal slot comprise substantially a quadrant of a circle. Two of the four edges form the first and second clamping edges, and these may be the adjacent or the opposite edges of the trapezoidal slot.

If the crossmember is to be attached at a position a little beyond that permitted by the trapezoidal slot, the conventional prior art connector means cannot be utilized. However, the connector means of the present invention may be utilized and coupled to the trapezoidal slot with the wedge clamping member in clamping engagement with parts of the first and second clamping edge of the trapezoidal slot. The trapezoidal opening in the limbs of the connector means would permit the crossmember to be moved beyond the limits of the trapezoidal slot. The wedge clamping member would be in clamping engagement with the first and second clamping sides of the trapezoidal opening also.

BRIEF DESCRIPTION OF THE DRAWINGS

FIG. 1 is a perspective view of a prior art upright member.

FIG. 2 is a side elevation view illustrating a prior art connector means for connecting a cross member to the upright member.

FIG. 3 is a plan view of the arrangement of FIG. 2.

DETAILED DESCRIPTION OF THE PREFERRED EMBODIMENT

Figure 4:
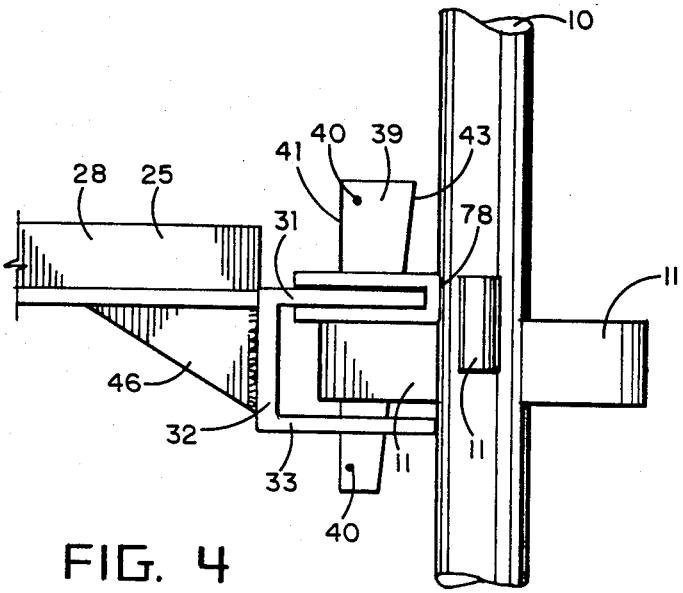
FIG. 4 is a side elevation view illustrating the connector means of the present invention coupled to the upright of FIG. 1.

FIGS. 1–3 show a prior art upright member 10 in the form of an ordinary scaffold tube having secured thereto clusters of V-shaped sockets 11 comprising a pair of spacer and header element supporting sockets 12 and 13 respectively. Individual sockets 11 are spaced symetrically around the periphery of the upright member 10.

The connecting portion of each socket 11 is slightly flattened and the internal face 15 thereof provides a clamping face extending substantially parallel to the adjacent side of the upright member 10. The upper face of the socket 11 extends substantially perpendicular to the adjacent side of the upright member 10 and provides a horizontally extending abutment surface for supporting connecting means 30*a*. Each upright member 10 of the scaffolding is provided with several clusters of sockets 11 equidistantly spaced along its length.

FIG. 2 is a side elevation view of the prior art connecting means 30*a* used to connect crossmember 25 to the sockets 11. The crossmember 25 is a transom element comprising a pair of angle members 26 and 27 (see FIG. 3) whose upstanding flanges are welded so as to provides a central upstanding flange 28. The horizontal surface of the angle members 26, 27 are adapted to support the ends of scaffold planks or the like to provide a platform for workmen.

Referring to FIGS. 2–3, base 32 of the C-shaped connector means 30*a* is mounted to the end of the crossmembers 25 through a triangular support plate 46 welded to the underside of the oppositely directed angle members 26, 27. The parallel arms of the C-shaped connector means 30*a* form an upper limb 31*a* and a lower limb 33*a* which are spaced apart a sufficient distance to enable the socket 11 to be received therebetween.

The outer ends of limbs 31*a*, 33*a* form abutment faces 34, 36 respectively, each face being adapted to bear against the adjacent side of the upright member 10 on either side of the socket 11.

The upper limb 31*a* has an elongated rectangular slot 37 and the lower limb 33*a* has another slot 38, the two slots being of dimensions suitable for receiving the wedge clamping member 39 associated with the connector means 30*a*.

The wedge clamping member 39 is provided with small protrusions 40 near each end. The slot 38 in the lower limb 33*a* is sufficiently wide to enable the protrusion 40 to be passed therethrough while the width of the slot 37 in the upper limb 31*a* is slightly less so as to prevent the protrusions 40 from being passed through it. By this arrangement the wedge member 39 may not be removed from association with its connector means 30*a*.

Once the cross member 25 is correctly positioned in relation to the socket 11, the wedge 39 can be driven downwardly with a hammer blow so that its vertically disposed clamping face 41 is brought into engagement with the internal clamping face 15 of the socket 11. Due to the wedging action of the vertical clamping face 41 and the inclined face 42 of the wedge 39, the abutment faces 34, 36 of the upper and lower limbs 31*a* and 33*a* respectively are brought into pressure engagement with the adjacent side of the upright member 10.

As can be seen from FIG. 3, the socket has only one abutment face 15 and as such the connector means 32 can be coupled to the socket at only that one position. The rectangular elongated slot 37 in the upper limb 31*a* allows only restrained up and down movement of the wedge 39, and this further limits coupling positions of the connector means 32 to the socket 11. If it is desired to attach the crossmember 25 to the upright 10 at an angle, for example at an angle midways between adjacent sockets 12 and 13, it would not be possible using the connector 30*a* of FIGS. 2–3.

Figure 5:
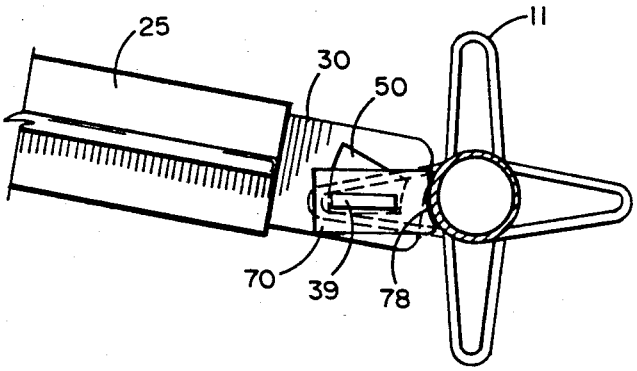
FIG. 5 is a plan view of FIG. 4.
Figure 6:
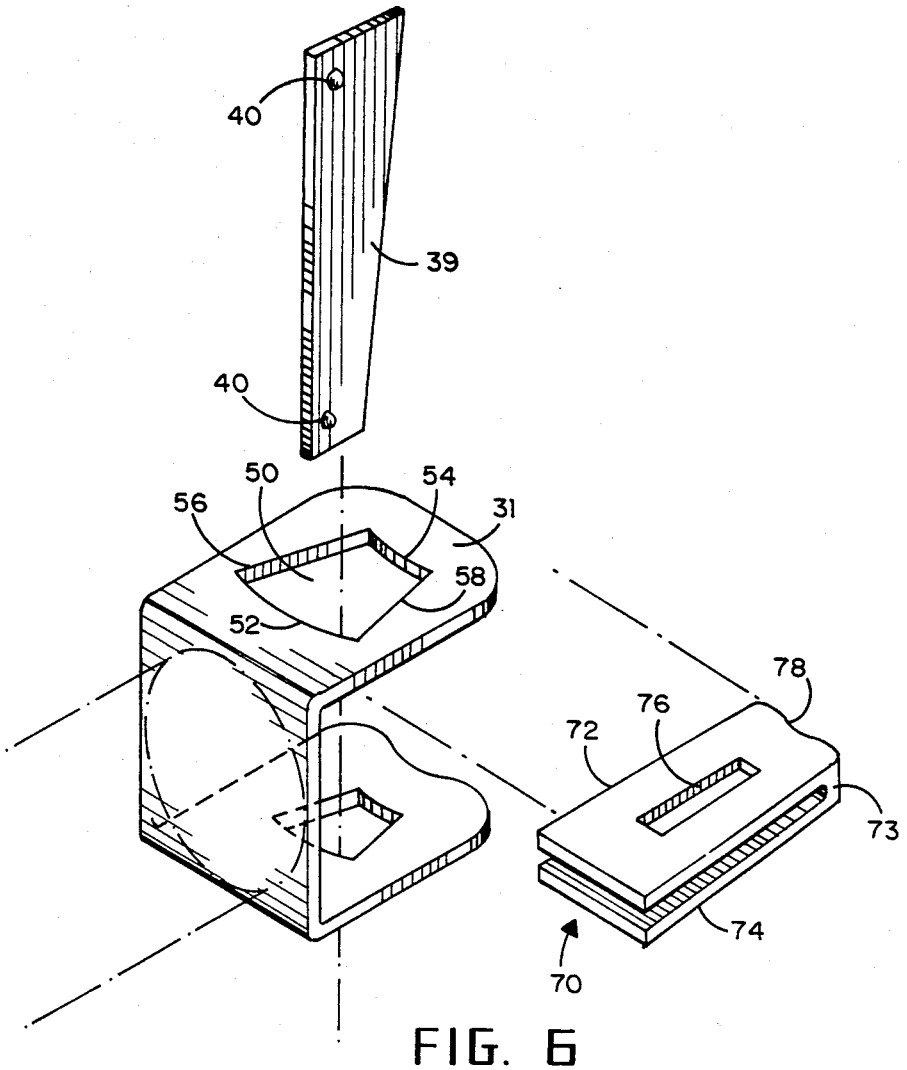
FIG. 6 is a perspective view showing the connector and the abutment coupling.
Figure 7:
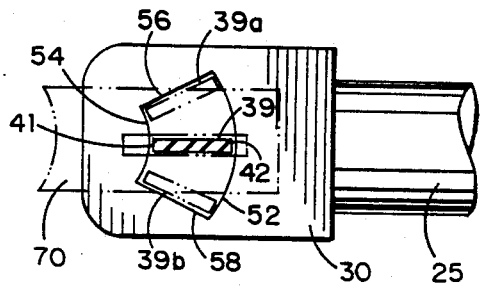
FIG. 7 is a plan view of the connector of the present invention showing the trapezoidal opening.
Figure 8:
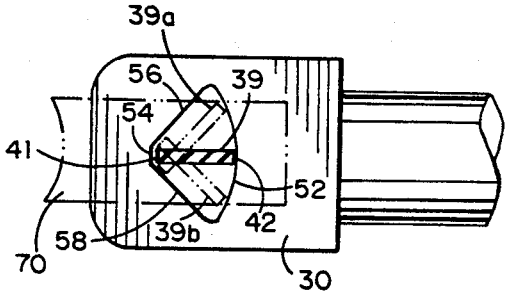
FIG. 8 is a plan view of the present connector means showing alternative configuration of the trapezoidal opening.

Referring now to FIGS. 4–8, the connector means of the present invention is illustrated therein. The connector means is a C-shaped member, similar to member 30*a* of FIGS. 2–3, attached at its base 32 to one end of the crossmember 25. The connector means has two spaced-apart limbs 31 and 33 to permit the socket 11 to be received therebetween, with limbs 31, 33 extending respectively above and below the socket. A generally trapezoidal opening 50 is provided in each of the two limbs 31 and 33. The trapezoidal opening 50 has four sides, 52, 54, 56 and 58. At least two of the four sides are non-parallel. If two of the four sides are linear, the opening 50 would form a trapezoid, and if one side is made very small the opening may form almost an equilateral triangle. However, it is preferred that one side 52 be arcuate as shown in FIGS. 6, 7 and 8. When the side 52 is arcuate, the side 54 may be formed as an arcuate side also, parallel to the side 52. The side 54 should be smaller than the side 52, as shown in FIGS. 6, 7 and 8. Additionally the trapezoidal opening 50 may be formed as shown in FIG. 8 with the side 54 being generally linear and of sufficient width to accomodate face 41 or 42 of the wedge 39, and the sides 56, 58 being situated at substantially right angles. The trapezoidal opening 50 allows the connecting member 30 to be coupled to the socket 11 at a range of positions within the dimensions and configuration of the four sides 52–58.

The wedge clamping member 39 passes through the trapezoidal opening 50 in the two limbs 31 and 33 and is mounted for clamping engagement with two of the four sides of the trapezoidal opening 50. These two sides are herein called first and second clamping sides. The first and second clamping sides 62 and 64 may be any two of the four sides 52–58. For example, FIG. 7 illustrates the wedge clamping member 39 mounted for clamping engagement with sides. Thus sides 52 and 54 now serve as the first and second clamping sides respectively. The FIG. 7 shows the wedge clamping member 39 in three positions, 39, 39*a*, and 39*b* at selected portions of the first and second clamping sides.

In FIG. 8 different sides serve as the first and second clamping sides. In FIG. 8, in the position 39 of the wedge clamping member, the first and second clamping sides are sides 52 and 54 respectively. In the position 39*a* of the wedge clamping member, the sides 52 and 58 serve as the first and second clamping sides respectively and in the position 39*b* of the wedge clamping member sides 52 and 56 serve as the first and second clamping sides respectively. In FIG. 8, in the position 39*a* and 39*b* of the wedge member 39, the first and second clamping sides are adjacent sides (52–56; 52–58) of the trapezoidal opening, whereas in FIG. 7 the first and second clamping sides are the opposite sides (52–54) of the trapezoidal opening 50.

In coupling the crossmember 25 and the upright 10 as in FIG. 4 using the connecting means 30 of the present invention, the socket 11 is received between the two limbs 31 and 33 and the wedge-clamping member 39 is passed through the trapezoidal opening 50 in the upper limb 31, the socket 11 and the trapezoidal opening 50 in the lower limb 33. The trapezoidal opening 50 allows the connecting means 30 of the crossmember 25 to be moved in a horizontal plane perpendicular to the longitudinal axis of the upright member 10, as shown in FIG. 5. The arcuate side 52 allows the crossmember 25 to be moved in a smooth and easy manner while the edge 42 of side 52 and edge 41 faces wedge 39 faces the side 54. After the crossmember 25 is positioned at the desired position the wedge member 39 is driven downwardly into pressure engagement with the sides 52 and 54 (these serving as the first and second clamping sides) of the trapezoidal opening 50 and the internal clamping face 15 of the socket 11.

The advantages of the trapezoidal opening 50 are that the crossmember 25 can be situated and attached at any position with respect to the longitudinal axis of the upright member 10 within the range of two of the four sides of the trapezoidal opening 50 selected to serve as first and second clamping sides, and is not restricted to one location as in the prior art (FIGS. 2 and 3).

The trapezoidal opening 50 in the second limb 33 need not be of the same size as the trapezoidal opening 50 in the upper limb 31, even if it is of the same shape. It may be dimensioned in proportion to the space between the two limbs 31 and 33, such that the wedge clamping member 39 is in clamping engagement with the first and second clamping sides of the trapezoidal opening 50 in the first limb 31 as well as in the second limb 33. In such cases, the size of the trapezoidal opening 50 in the second limb 33 will take into account the angle of slope of the edge 42 of the wedge clamping member 39 as well and will be proportioned accordingly.

If it is not required that the wedge clamping member 39 be in clamping engagement with both of the trapezoidal openings 50 in the first and second limbs 31 and 33, the trapezoidal opening 50 in the second limb 33 may be of the same size as in the first limb 31 and the wedge clamping member would be in clamping engagement with only the two sides serving as the first and second clamping sides of the trapezoidal opening 50 in the first limb 31.

Figure 6A:
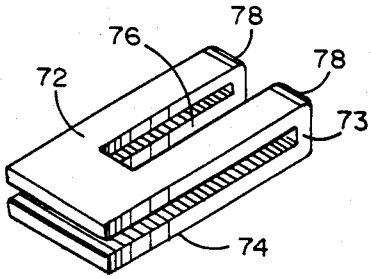
FIGS. 6*a* and *b* and *c* are perspective views showing different shapes of the abutment coupling.
Figure 6B:
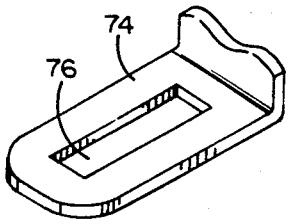
FIG. 6*d* is a perspective view showing use of the connector without the abutment coupling.
Figure 6C:
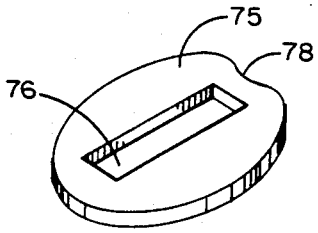
Figure 6D:
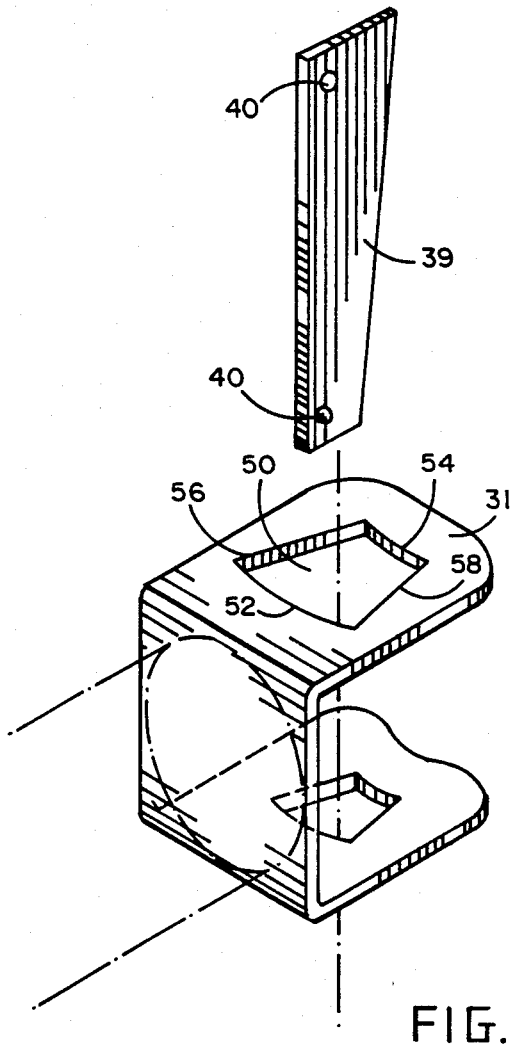

The connector means 30 of the present invention is further provided with an abutment coupling 70 having two spaced apart arms 72 and 74 for permitting one of the limbs, for example 31, to be received therebetween (FIG. 6–6*c*). The arms 72, 74 are provided with an aperture 76 which is configured to permit the wedge clamping member 39 to pass therethrough free of any clamping action. The abutment coupling 70 has a joining portion 73 joining one end of the arms 72 and 74. The outer end of the joining portion 73 forms an abutment face 78. The abutment face 78 is configured to bear against the outer surface of the upright member 10. For example, if the upright member is a circular tube or pipe, the abutment face 78 is complementarily arcuate. Preferably the first and second arms 72 and 74 are parallel and the abutment face 78 depends at right angles from the arm 72.

The aperture 76 is configured to prevent any sideways movement of the wedge clamping member 39. For example, if the wedge 39 is rectangular in cross-section, the aperture 76 is configured as a rectangle also. Thus the wedge can move only up and down within the aperture 76. The aperture 76 does not permit the protrusions 40 to pass through and this ensures that the wedge member 39 is not removed from association with the connector means 30.

In using the abutment coupling 70, the wedge member 39 passes through the aperture 76 in the first arm 72, the trapezoidal opening 50 in the upper limb 31, the aperture 76 in the second arm 74, the socket 11, and the trapezoidal opening 50 in the lower limb 33. When the wedge clamping member 39 is hammered down for clamping engagement, the wedge action of the inclined face 42 of the wedge member 39 forces the abutment face 78 to abut and bear against the outer surface of the upright member 10 and thereby provide support for the connector means 30.

FIGS. 4–8 show the abutment coupling 70 coupled to the upper limb 31 only. It is possible to provide an abutment coupling on both the limbs 31, 33 or only the lower limb 33. If the abutment coupling is provided on the lower limb, it will have to be dimensioned to allow the protrusions at the lower or tapering end of the wedge clamping member 39 to pass therethrough. This is necessary in order to allow the socket 11 to be received between the limbs 31 and 33.

FIGS. 6*a*, *b* and *c* show different arrangements of the abutment coupling. In FIG. 6*a* the apertures 76 in the upper and lower arms extend out and split the abutment face 78 into two. In other words a single aperture 76 extends from the upper arm to the lower arm. In FIG. 6*b* the abutment coupling is missing its upper arm. The arrangement of FIG. 6*b* may be situated between the upper and lower limbs 31 and 33 and the protrusion 40 would prevent separation thereof from the connector means 30.

In FIG. 6*c* the abutment coupling is formed as a flat planar plate member 75, preferably circular or elliptical in shape and having a portion contoured to form the abutment face 78.

Second Application

Figure 9:
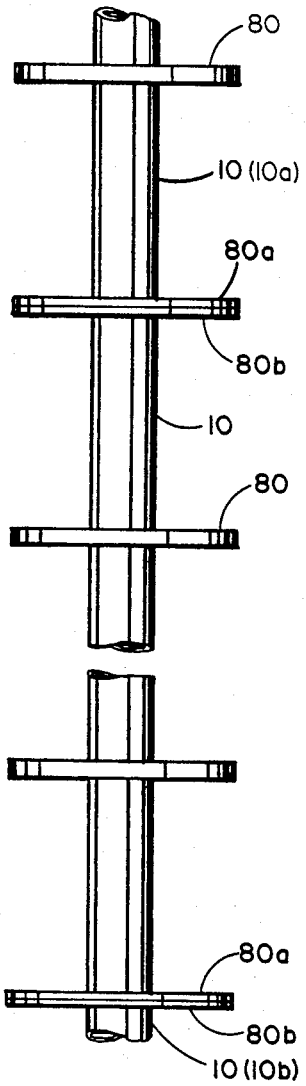
FIG. 9 is a perspective view of an upright provided with donut-shaped plates.

The connector means 30 of the present invention can be used with a type of upright which does not have sockets 11. Referring to FIG. 9 therein is shown an upright 10 having donut-shaped plates or disks 80 welded thereto at spaced intervals along its lengths. The disks 80 have plurality of slots 82 which are located around the disk at selected angles, for example every 22.5°, and a generally trapezoidal slot 84 having first edge 85, second edge 86, third edge 87, and fourth edge 88. The trapezoidal slot 84 is an option, and may be provided together with or apart from the slots 82. It can be readily observed that the slots 82 would permit the crossmember 25 to be coupled thereto every 22.5° rather than every 90° as in the prior art FIGS. 2 and 3. The conventional connector means 30*a* of FIGS. 2 and 3 may be utilized with the disk 80. The disk increases the number of connecting positions for the prior art connector 30*a*.

Even with the large selection of connecting positions allowed by the disk 80, it may be desired to connect the crossmember 25 at a position located between two adjacent slots, for example 90 and 91. Here the conventional connector 30*a* of FIGS. 2 and 3 cannot be utilized. However, the connector means 30 of the present invention may be utilized in the same manner as shown in FIGS. 4–8.

Figure 10:
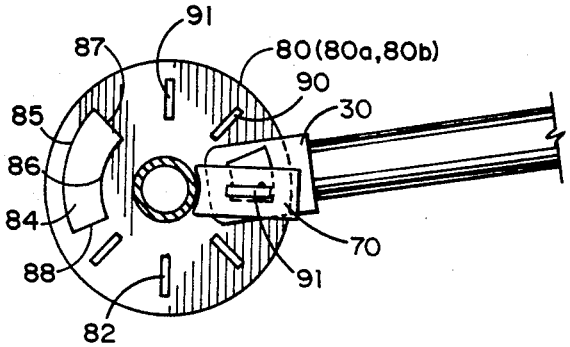
FIG. 10 is a plan view showing the connector means of the present invention coupled to the upright of FIG. 9.
Figure 11:
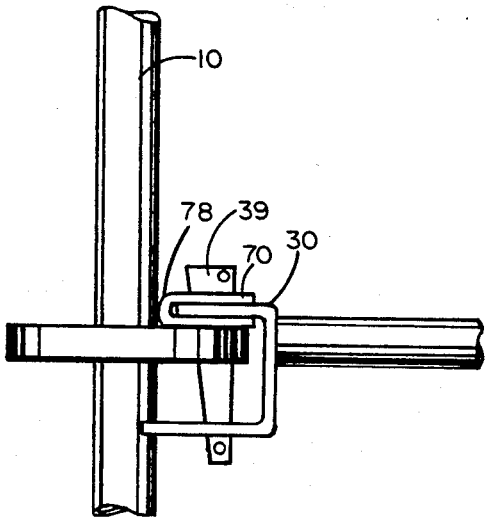
FIG. 11 is a side elevation view of FIG. 10.

For example, in FIGS. 10–11, the connector means 30 of the present invention is shown coupled to slot 91 of the disk 80 with the wedge clamping member 39 passing through the slot 91. The crossmember 25 can be moved horizontally to the desired position between slots 91 and 90 due to the trapezoidal opening 50. A hammer blow is delivered to the wedge member 39 so that its vertically disposed clamping face 41 is brought into engagement with the clamping face 91*a* of the slot 91. Due to the wedging action, the inclined face 42 of wedge 39 is brought into engagement with the clamping face 91*b* of slot 91 so as to force the abutment face 78 of the abutment coupling 70 into pressure engagement with the adjacent side of the upright member 10. FIG. 10 illustrates the plan view and FIG. 11 the side view of this coupling arrangement.

The generally trapezoidal slot 84 in the donut plate allows the conventional connector 30*a* of FIGS. 2–3 to be utilized to couple crossmembers, and have the same versatility provided by the connector means 30 of the present invention. The arcuate first and second edges 85 and 86 serve a similar function as the first and second clamping sides 52, 54 of FIGS. 4–8. The conventional connector means 30*a* may be coupled to opening 84 with the wedge clamping member 39 in clamping engagement with a portion of the first and second clamping edges 85 and 86. The trapezoidal slot 84 provides a range of possible connecting positions.

The trapezoidal slot 84 may be configured differently than shown in FIG. 10, and may be formed as shown for the trapezoidal slot 50 in FIGS. 5–8. For example, edges 87 and 88 may be linear and situated at substantially right angles, similar to the opening 50 in FIG. 8. Also, one edge 85 may be arcuate and the edge 85, opposite thereto be made so small that the trapezoidal slot comprises substantially a quadrant of a circle, much like the opening 50 in FIG. 8. Further, the first and seconc clamping edges of the trapezoidal slot 84 may be the adjacent (85–87; 85–88) or opposite edges (85–86).

With the arrangement of the trapezoidal slot 84, if it is desired to connect the crossmember at a position slightly beyond the edges 87 or 88, the prior art connector 30*a* cannot be used, however, the connector means 30 of the present invention may be utilized. The connector means 30 may be attached to the edge 87 (or 88) in the same manner as it attaches to slot 91 in FIGS. 7–8, and the crossmember 25 can be moved beyond the edges 87 (or 88) within the range permitted by the trapezoidal opening 50 before the wedge clamping member 39 is pressed down for clamping engagement. The wedge clamping member is in clamping engagement with the first and second clamping edges of the trapezoidal slot 84, as well as the first and second clamping sides of the trapezoidal opening 50.

From the above it can be seen that the donut plate 80 greatly increases the versatility of the connector means 30, and even more so when the donut plate 80 is provided with trapezoidal slot 84.

A particularly useful feature of the donut plates should be noted here. In building a scaffolding system the upright members 10 are stacked one on top of the other. The donut plate 80 may be provided at each end of the upright members 10, 10*a* and 10*b*, as shown in FIG. 9. The broad area of the donut plate 80*b* provides a large area to support the donut plate 80*a* and thereby the upright member 10*a*. The donut plates 80*a* and 80*b* may be one-half as thick as donut plate 80, i.e., if donut plate 80 is one inch thick, 80*a* and 80*b* each is one-half inch thick. In this manner when 80*a* is stacked on top of 80*b*, it provides the same thickness as 80.

Whereas the present invention has been described in particular relation to the drawings attached hereto, it should be understood that other and further modifications apart from those shown or suggested herein may be made within the spirit and scope of this invention. It is understood that this invention is not restricted to the particular drawings shown herein but is to be restricted and limited only by the claims and the full range of equivalency to which each element thereof be entitled to.

The connector is adapted to be utilized with a type of upright having donut-shaped disks mounted coaxially thereon. The disks have a plurality of slots therein which allows even the conventional prior art connector to be attached at a great number of positions. The connector of the present invention may be utilized to provide connection somewhat displaced from the slots.

The donut plates may be provided at the ends of the upright member to provide an increased area to support when one upright member is stacked on top of another.

What is claimed is:

1. In builders' scaffolding having an upright member, and a plurality of sockets provided thereon for coupling crossmembers thereto, said sockets having an internal clamping face, a connector means coupled to one end of said crossmembers comprising:

(a) two spaced apart limbs to permit said socket to be received therebetween with said limbs extending respectively above and below said socket;

(b) a generally trapezoidal opening having four sides, two of which are non-parallel, provided in said limbs, two of said for sides forming first and second clamping sides, said first and second clamping sides having a plurality of clamping positions, (c) a wedge clamping member mounted for clamping engagement with said internal clamping face of said socket and selected ones of said plurality of clamping positions on said first and second clamping sides; and (d) an abutment coupling including (i) two spaced-apart arms for permitting at least one of said limbs to be received therebetween;

(ii) an aperture provided in said arms for permitting said wedge clamping member to pass therethrough free of clamping action; and (iii) an abutment face for abutting said upright member when said wedge clamping member is in pressure engagement with said first and second clamping sides and said internal clamping face of said socket;

whereby in connecting said upright member and said crossmember together said two limbs extend respectively above and below said socket, and said wedge is in pressure engagement with portions of said first and second clamping sides of said trapezoidal opening in at least one of said limbs and said internal clamping face of said socket.

2. In builders' scaffolding having an upright member and a plurality of sockets provided thereon for coupling crossmembers thereto, said sockets having an internal clamping face, a connector means coupled to one end of said crossmembers comprising:

(a) two spaced apart limbs to permit said socket to be received therebetween with said limbs extending respectively above and below said socket;

(b) a generally trapezoidal opening having four sides, at least two of which are non-parallel provided in said limbs, two of the four sides forming parallel arcuate first and second clamping sides, the second clamping side being smaller than the first clamping side; and linear sides connecting the ends of said first and second clamping sides;

(c) a wedge clamping member mounted for clamping engagement with said internal clamping face of said socket and selected portions of said first and second clamping side; and (d) an abutment coupling including (i) two spaced apart arms for permitting at least one of said limbs to be received therebetween;

(ii) an aperture provided in said arms for permitting said clamping member to pass therethrough free of clamping action; and (iii) an abutment face for abutting said upright member when said wedge clamping member is in pressure engagement with said first and second clamping sides and said internal clamping face of said slot;

whereby in connecting said upright member and said crossmember together said two limbs extend respectively above and below said socket, and said wedge clamping member is in pressure engagement with portions of said first and second clamping sides of said generally trapezoidal opening and said internal clamping face of said socket.

* * * * *

UNITED STATES PATENT AND TRADEMARK OFFICE

CERTIFICATE OF CORRECTION

PATENT NO. : 4,525,096

DATED : June 25, 1985

INVENTOR(S) : J.L. GREEN & S.B. HACKETT

It is certified that error appears in the above—identified patent and that said Letters Patent is hereby corrected as shown below:

| | |
|---|---|
| Column 6, line 54 | "62 and 64" should be deleted. |
| Column 6, line 57 | After "sides" in the first instance, insert --52 and 54--; |
| Column 9, line 42 | "85" in the second instance should read --86--; |

Signed and Sealed this

*Fifteenth* Day of *October 1985*

[SEAL]

*Attest:*

*Attesting Officer*

DONALD J. QUIGG

*Commissioner of Patents and Trademarks—Designate*